United States Patent [19]

Harter

[11] Patent Number: 4,738,586

[45] Date of Patent: Apr. 19, 1988

[54] COMPRESSOR BLADE TIP SEAL

[75] Inventor: Franz Harter, Marlborough, Conn.

[73] Assignee: United Technologies Corporation, Hartford, Conn.

[21] Appl. No.: 49,043

[22] Filed: Mar. 6, 1987

Related U.S. Application Data

[63] Continuation-in-part of Ser. No. 710,270, Mar. 11, 1985, abandoned.

[51] Int. Cl.[4] ..... F01D 11/08

[52] U.S. Cl. ..... 415/170 R

[58] Field of Search ..... 415/170 R, 172 R, 172 A, 415/174, 199.5, DIG. 1; 416/183

[56] References Cited

U.S. PATENT DOCUMENTS

| | | | |
|---|---|---|---|
| 2,988,325 | 6/1961 | Dawson | 415/172 A |
| 3,129,876 | 4/1964 | Forster | 415/194 |
| 3,677,660 | 7/1972 | Taniguchi et al. | 415/219 R |
| 4,238,170 | 12/1980 | Robideau | 415/172 A |
| 4,239,452 | 12/1980 | Roberts | 415/172 A |
| 4,606,699 | 8/1986 | Hemsworth | 415/170 R |
| 4,645,417 | 2/1987 | Wisler | 415/170 R |

FOREIGN PATENT DOCUMENTS

| | | | |
|---|---|---|---|
| 893205 | 6/1944 | France | 416/183 |
| 1218301 | 5/1960 | France | 415/121 B |
| 10179 | of 1912 | United Kingdom | 415/172 A |
| 753652 | 7/1956 | United Kingdom | 415/119 |

*Primary Examiner*—Robert E. Garrett
*Assistant Examiner*—John T. Kwon
*Attorney, Agent, or Firm*—Norman Friedland

[57] ABSTRACT

The trench inner wall surrounding the tips of axial flow fan/compressor blades in a turbine type power plant is angularly disposed relative to the gas path wall to allow deeper penetration into the trench and minimize leakage around the tips. Gap closure between the inner wall of the trench and tip is contemplated by the contour of the blade/trench.

5 Claims, 1 Drawing Sheet

HIGH PRESSURE
LOW PRESSURE
HIGH PRESS.
LOW PRESS.
FLOW
FLOW

COMPRESSOR BLADE TIP SEAL

This is a request for filing a continuation-in-part application under 37 CFR 1.62 of prior pending application Ser. No. 710,270 filed on Mar. 11, 1985, now abandoned.

DESCRIPTION

1. Technical Field

This invention relates to axial flow fans/compressors of gas turbine engines and particularly to the relationship of the tips of the blades to the adjacent shroud or rub strip.

2. Background Art

U.S. Pat. No. 4,239,452 granted to Frank Roberts, Jr. on Dec. 16, 1980 entitled Blade Tip Shroud for a Compressor Stage of a Gas Turbine Engine and U.S. Pat. No. 4,238,170 granted to Brian A. Robideau and Juri Niiler on Dec. 9, 1980 entitled Blade Tip Seal for an Axial Flow Rotary, both of which were assigned to United Technologies Corporation, the assignee common to the present patent application disclose shrouds that include trenches adjacent the tips of the blades.

As disclosed in U.S. Pat. No. 4,238,170 supra, for example, the tips of the compressor blades extend adjacent the surrounding shroud or rub strip that is trenched or recessed to the dimension complimentary to the outer station and tip of the blade. In some instances, say at the low pressure stages where soft abradable materials such as a synthetic rubber can be utilized, the blades which move radially outward during engine acceleration, machine the groove. Obviously, this technique assures a close fit of the mating parts and helps in avoiding leakage around the tips of the blade.

The problem constantly plaguing the engine technical people is how to maintain this leakage to a minimum, if not prevent it. While the designs disclosed in the above mentioned patents help toward this end, leakage is still prevalent.

Other techniques for minimizing tip leakage is discussed in the above-mentioned patents. Suffice it to say that the present invention is an improvement over the techniques taught in these patents, supra, and serve to improve engine operating efficiencies over and above that attainable by the heretofore known designs.

DISCLOSURE OF INVENTION

A feature of the invention is to provide a slanted trench in the rub strip, shroud, or the engine case of a gas turbine engine adjacent the tips of the blades of the fan and/or compressor. The contour of the blade and the inner wall as seen by the cross section of the trench is angularly disposed relative to the flow path wall.

This invention contemplates that the angular contour is designed to effectuate a closure in the gap between the inner wall of the trench and the tip of the blade upon displacement of the compressor and/or fan blade arising out of the growth of the materials resulting from stable speed and temperature operating conditions. Other features and advantages will be apparent from the specification and claims and from the accompanying drawings which illustrate an embodiment of the invention.

BEST MODE FOR CARRYING OUT THE INVENTION

Figures 1, 2, 3, 4:
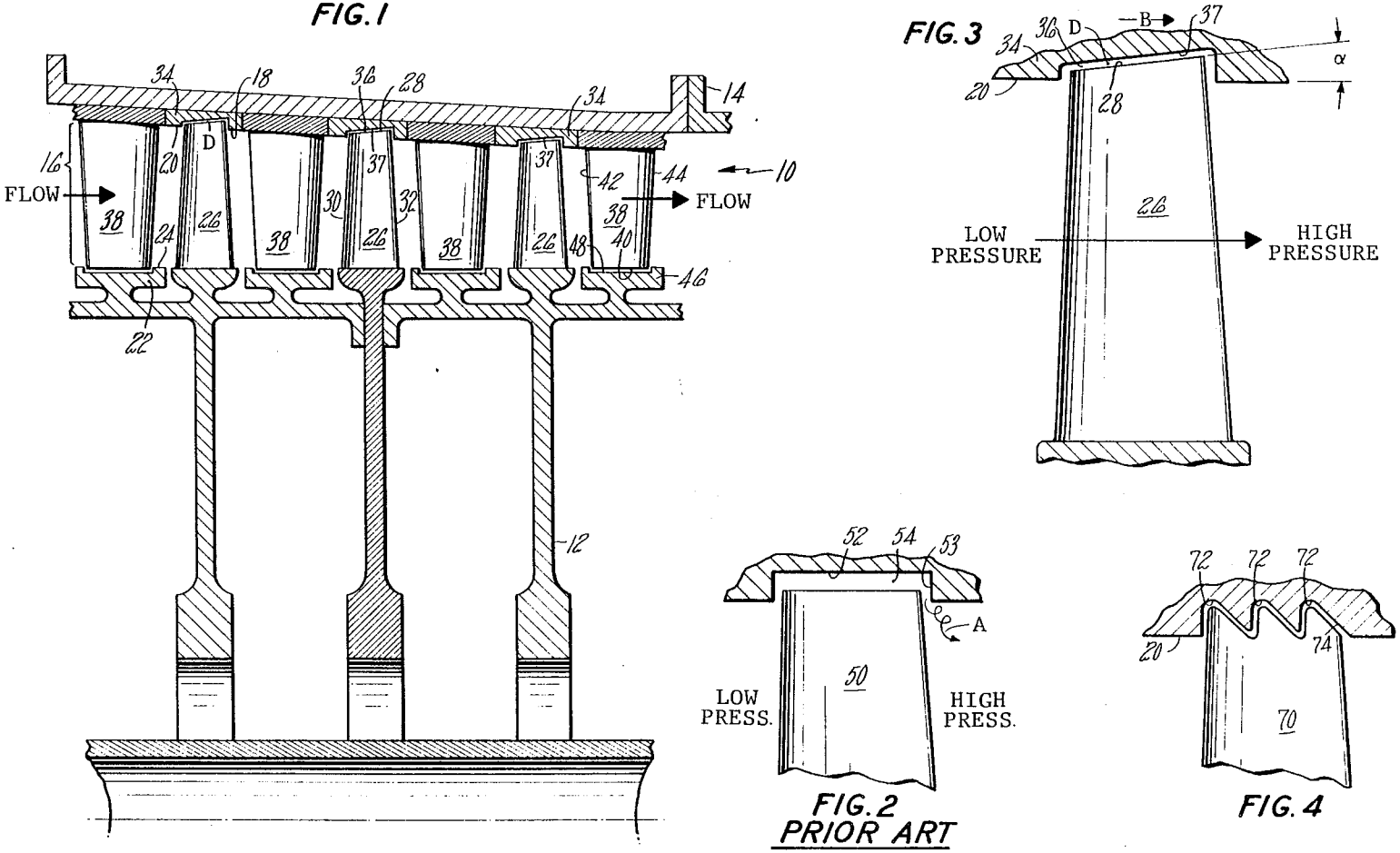
FIG. 2 PRIOR ART
FIG. 1 is a partial view in section of a compressor section of a gas turbine engine schematically showing the slanted trench of the casing wall or rub strip of this invention.
FIG. 2 is an enlarged view of a nonslanted trench adjacent the tip station of a compressor blade of the prior art design.
FIG. 3 is an enlarged view of one of the blades and the attendant slanted trench in the engine casing.
FIG. 4 is a partial view of the tip stations and trench illustrating another embodiment of this invention.

The invention in its preferred embodiment is illustrated for use in the lower temperature stations of a gas turbine engine and particularly in the compressor section where a soft material circumscribes the engine's inner diameter of the engine case and is abradable so as to be susceptible of being machined by the operation of the rotating blades. Thus, as disclosed in the U.S. Pat. No. 4,238,170, supra, the blades at zero rotational speeds are spaced from the inner diameter of the rub strip and when accelerated to its highest operating speed, cut into the rub strip to define the trench. It is, however, to be understood and as will be obvious to one skilled in this art, the trench shape can be machined out prior to engine operation. What is considered the improvement by the teachings of this invention is the particular contour of the tips of the blades and its cooperating trench.

A portion of a compression section 10 of an axial flow compressor of a gas turbine engine is illustrated in FIG. 1. A flow path 16 for working medium gases extends axially through the compression section. An outer wall 18 having an inwardly facing surface 20 and an inner wall 22 having an outwardly facing surface 24 form the flow path. A plurality of axially spaced rows of rotor blades as represented by the single blades 26 extend outwardly from the rotor across the flow path into proximity with the outer wall. Each blade has an unshrouded tip 28 and is contoured to an airfoil cross section. Accordingly, each blade has a pressure side and a suction side and, as illustrated, has a leading edge 30 and a trailing edge 32. Extending over the tips of each row of rotor blades is a stator seal land 34. Each land has a circumferentially extending groove 36 formed therein to a depth D at an inwardly facing surface 37 thereof.

A plurality of rows of stator vanes represented by the single vanes 38 are cantilevered inwardly from the stator across the flow path into proximity with the inner wall. Each vane, which in this illustration has an unshrouded tip 40V, is contoured to an airfoil section. Accordingly, each vane has a pressure side and a suction side and, as illustrated, has an upstream end 42 and a downstream end 44. Extending over the tips of each row of stator vanes is a rotor seal land 46. Each land has a circumferentially extending groove 48 formed therein.

In the nonoperating condition the blade tips 28 are spaced from the inwardly facing surface 20. The gap between tips and surface enables assembly of the components. In response to centrifugally and thermally generated forces as the machine is accelerated to high operating speeds, the rotor tips grow radially outward machining the groove 36 in the stator seal land 34. The point of closest proximity of the blades to the bottom of the groove is referred to as the "pinch point" and normally occurs during a transient engine operating to a maximum speed or power condition. As the engine reaches thermal stability at a given operating speed the outer wall including the land, moves both axially and radially relative to the blade tips to a position at which the blade tips and inner surface 37 define a gap.

A problem with the heretofore design as illustrated in FIG. 2 which is a prior art design is that the blade 50 penetration into the trench increases with operating speed and causes pumping of air against the trench vertical wall 53 which creates turbulence. The turbulence as shown by arrow A, essentially becomes a blockage in the flow path of the gas engine's working medium and adversely affects performance. The maximum depth of blade tip penetration must be controlled to avoid unreasonable turbulence losses at the maximum operating speed. At low speed operating the blade will not penetrate into the trench and leakage can readily occur between the flow path outer wall and the blade tip.

Ideally, it is desirable to match the pressure gradient across the tip which tends to leak air from the high pressure side to the low pressure side by the pressure created by the tip pumping action. In the heretofore shown embodiment the full width of the blade works on the air and has the tendency of over pressurizing this air and hence, creates the undesirable turbulence.

According to this invention the tip of the blade is contoured to be angularly disposed relative to the gas path wall. Hence, in this design the angle of said contour of the tips of the blades relative to the engine's centerline is different than the angle of said inner wall of said case relative to the engine's centerline. The radius of the trailing edge 32 is larger than the radius of the leading edge 30. This is best seen in FIG. 3. As the trench is machined as described above, the trench is formed to define the contour of the inner surface 37. Looking at the cross section of the trench it is apparent that the axial extension of surface 37 relative to the flow path defined by wall 20 forms angle alpha $\alpha$. By virtue of this contour, two important features are realized:

(1) The full width of the blade pumped against the vertical trench wall in the situation of the heretofore design as soon as any portion of the blade tip penetrated into the trench. Thus the blade penetration is minimal prior to creating undesirable turbulence. Only the aft portion (adjacent trailing edge 32) of the blade tip pumps against the trench vertical wall in FIG. 2 when the speed is attained to cause the blade tip to penetrate into the trench. Thus the blade tip can penetrate deeper into the trench prior to creating the limiting condition of turbulence. At lower operating speed conditions the revised tip design will permit penetration whereas the heretofore design did not permit penetration. (2) By slanting the trench in the proper direction, the gap will be reduced by the relative axial motion between the blade tip and trench outer wall as these engine parts achieve thermal stability at any given engine speed condition. Thus knowing the axial growth direction of the case, say in the direction of the arrow B relative to the blade's axial motion, it is apparent that gap D tends to become smaller.

FIG. 4 exemplifies another configuration on how the tip can be contoured to combat the leakage problem alluded to in the above. As noted the tip of blade 70 is contoured in a sawtooth fashion providing a plurality of parallel channels 72. In each channel the inner surface 74 is angularly disposed to the gas path wall providing similar benefits as was described above.

The preferred embodiment described in connection with FIG. 3 has proven to be particularly efficacious resulting in perhaps a 0.1 or 0.2% improvement in specific fuel consumption as evidenced on the PW2037 engine manufactured by Pratt & Whitney Aircraft of United Technologies Corporation, the assignee of this patent application.

It should be understood that the invention is not limited to the particular embodiments shown and described herein, but that various changes and modifications may be made without departing from the spirit and scope of this novel concept as defined by the following claims.

I claim:

1. For a gas turbine engine with high and low power operating conditions having an engine case, a rotor with a plurality of radially extending unshrouded blades rotatably supported in said engine case, said blades having a leading edge and a trailing edge relative to the flow of the engine's working medium, the portion of said engine case having a circumferentially extending trench having an inner surface and a vertical wall, the inner surface facing the tips of said blades and having a contour complimenting the contour of the tips of said blades and fairing into an increasing diameter extending from the leading to trailing edge, the inner wall of said engine case and the outer surface of said rotor defining a flow path for said engine's working medium, said inner surface of said trench being angularly contoured relative to said inner wall of the engine case, whereby a portion of said tips of said blades at the trailing edge is positioned into said trench when in the lower power operating condition so as to provide a pumping action of the air against said side wall of said trench adjacent said trailing edge so as to prevent said working medium from migrating from the high pressure side of said blades to the low pressure side of said blades.

2. An engine as claimed in claim 1 wherein the tip of said blade slanting from a given diameter at the leading edge to a higher diameter at the trailing edge such that said higher diameter portion of said tip penetrates said trench when said power plant is operating at said lower power.

3. An engine as claimed in claim 2 wherein said engine casing has a particular direction of growth and the direction of said slant is selected to be in the direction to minimize the gap between the tip of said blade and the inner surface of said trench upon growth of said engine casing.

4. An engine as in claim 1 including an abradable material lining said inner wall adjacent the tips of said blades and said trench being machined into said abradable material by accelerating said engine to said high power operating condition whereby said blades expand radially.

5. In combination, a gas turbine engine operable over a power range, having an engine case, a plurality of axially spaced rotors having a plurality of radially extending blades forming stages of compression in the compression section of said engine rotatably supported in said engine case, said blades having a leading edge and a trailing edge relative to the flow of the engine's working medium, an inner wall on said engine case and an outer surface on said rotor defining a gas path for the engine's working medium, said inner wall of said engine case being made from an abradable material so that the tips of said blades move radially outward to machine a trench overlying said tips when said engine is accelerated to the high power of said range, each of said tips of said blades having a contour in an axial direction from the leading edge to the trailing edge complementing the contour formed on the inner surface of said trench, the tips of each of said blades at the trailing edge penetrating into said trench when said engine is operating to a lower power of said range defining with the sidewall of the trench a flow dam turning the leakage flow of the engine's working medium adjacent said tips to direct the flow of said working medium from the high to the lower pressure around said tips into the flow path of the engine's working medium and the angle of said contour of the tips of the blades relative to the engine's centerline is different than the angle of said inner wall of said case relative to the engine's centerline.

* * * * *